US010480468B2

(12) United States Patent
Heinemann

(10) Patent No.: US 10,480,468 B2
(45) Date of Patent: Nov. 19, 2019

(54) HIGH-PRESSURE CONNECTIVE DEVICE, HIGH-PRESSURE FUEL PUMP, AND METHOD FOR PRODUCING A HIGH-PRESSURE CONNECTION DEVICE FOR A HIGH-PRESSURE FUEL PUMP

(71) Applicant: CONTINENTAL AUTOMOTIVE GMBH, Hannover (DE)

(72) Inventor: Eyk Heinemann, Cham (DE)

(73) Assignee: CPT Group GmbH, Hannover (DE)

( * ) Notice: Subject to any disclaimer, the term of this patent is extended or adjusted under 35 U.S.C. 154(b) by 0 days.

(21) Appl. No.: 15/573,078

(22) PCT Filed: Apr. 5, 2016

(86) PCT No.: PCT/EP2016/057442

§ 371 (c)(1),
(2) Date: Nov. 9, 2017

(87) PCT Pub. No.: WO2016/184599

PCT Pub. Date: Nov. 24, 2016

(65) Prior Publication Data

US 2018/0112639 A1 Apr. 26, 2018

(30) Foreign Application Priority Data

May 21, 2015 (DE) ..... 10 2015 209 263

(51) Int. Cl.
*F02M 55/00* (2006.01)
*F02M 59/44* (2006.01)
*F02M 39/02* (2006.01)

(52) U.S. Cl.
CPC ..... *F02M 55/005* (2013.01); *F02M 59/44* (2013.01); *F02M 39/02* (2013.01); *F02M 2200/03* (2013.01); *F02M 2200/8076* (2013.01); *F02M 2200/8084* (2013.01)

(58) Field of Classification Search
CPC ..... F02M 55/005; F02M 59/44; F02M 39/02; F02M 2200/03; F02M 2200/8076; F02M 2200/8084
See application file for complete search history.

(56) References Cited

U.S. PATENT DOCUMENTS 4,893,601 A 1/1990 Sugao
8,419,073 B2 * 4/2013 Harhoff ..... F02M 55/025 123/456

(Continued)

FOREIGN PATENT DOCUMENTS

CN 1746482 A 3/2006
CN 101678499 A 3/2010

(Continued)

OTHER PUBLICATIONS

International Search Report and Written Opinion dated Jun. 17, 2016 of corresponding PCT application PCT/EP2016/057442.

(Continued)

*Primary Examiner* — Joseph J Dallo

(57) ABSTRACT

The invention relates to a high-pressure connection device (50) for a high-pressure fuel pump (10), having the following: —an outlet device (18) for discharging fuel (14) from the high-pressure fuel pump (10); —a connection device (22) for connecting the outlet device (18) to elements arranged downstream of the outlet device; —a welding seam (30) for connecting the outlet device (18) and the connection device (22); and —a pretensioning device (52) for exerting a pretension force ($F_v$) onto the welding seam (30) in the direction of the outlet device (18). The invention further relates to a high-pressure fuel pump (10) which has such a high-pressure connection device (50) and to a method for producing such a high-pressure connection device (50).

20 Claims, 8 Drawing Sheets

(56) References Cited

U.S. PATENT DOCUMENTS

| | | | | |
|---|---|---|---|---|
| 8,474,436 | B2 * | 7/2013 | Mancini | F02M 59/366 123/446 |
| 8,672,652 | B2 * | 3/2014 | Munakata | B23K 11/16 417/437 |
| 9,145,860 | B2 | 9/2015 | Usui et al. | |
| 2001/0003282 | A1 * | 6/2001 | Rumpf | F02M 37/08 123/510 |
| 2006/0054139 | A1 * | 3/2006 | Yamamoto | F02M 55/004 123/468 |
| 2007/0079813 | A1 * | 4/2007 | Kramer | B01D 29/606 123/511 |
| 2011/0012342 | A1 | 1/2011 | Harhoff et al. | |
| 2012/0012084 | A1 * | 1/2012 | Petrone | F02M 59/06 123/468 |
| 2015/0071111 | A1 * | 3/2015 | Tao | H04L 45/02 370/254 |
| 2017/0248107 | A1 | 8/2017 | Ellenberg et al. | |

FOREIGN PATENT DOCUMENTS

| | | | |
|---|---|---|---|
| CN | 101857171 | A | 10/2010 |
| CN | 202484503 | U | 10/2012 |
| CN | 203962245 | U | 11/2014 |
| DE | 102008013575 | B3 | 8/2009 |
| EP | 2388470 | A1 | 11/2011 |
| EP | 2388470 | B1 | 11/2014 |
| JP | H10213044 | A | 8/1998 |
| JP | 2001295735 | A | 10/2001 |
| JP | 2004068997 | A | 3/2004 |
| JP | 2011179319 | A | 9/2011 |
| KR | 101511962 | B1 | 4/2015 |
| WO | 2016041973 | A1 | 3/2016 |

OTHER PUBLICATIONS

Office Action dated Mar. 9, 2016 of corresponding DE application 10 2015 209 263.1.

Japanese Office Action dated Feb. 5, 2018 for corresponding Japanese application No. 2017-528991.

Japanese Notice of Allowance dated Oct. 1, 2018 for corresponding Japanese application No. 2017-528991.

Korean Notice of Allowance dated Nov. 19, 2018 for corresponding Korean application No. 10-2017-7012801.

Chinese Office Action dated Apr. 26, 2019 for corresponding Chinese application No. 201680029358.

* cited by examiner

HIGH-PRESSURE CONNECTIVE DEVICE, HIGH-PRESSURE FUEL PUMP, AND METHOD FOR PRODUCING A HIGH-PRESSURE CONNECTION DEVICE FOR A HIGH-PRESSURE FUEL PUMP

The invention relates to a high-pressure connection device by way of which a high-pressure fuel pump can be connected to elements of a fuel injection system that in the flow direction of a fuel are downstream of the high-pressure fuel pump. The application furthermore relates to a method for producing such a high-pressure connection device, and to a high-pressure fuel pump which is equipped with such a high-pressure connection device.

Fuel injection systems are generally used for injecting a fuel such as, for example, diesel or gasoline into combustion chambers of internal combustion engines. The fuel in the fuel injection system is charged with a high pressure in the range from 200 bar-300 bar when gasoline is used as fuel, and in the range from 2000 bar-3000 bar when diesel is used as fuel. The charging with pressure herein is performed in a high-pressure fuel pump in which a pump piston moves in a translatory manner such that said pump piston periodically expands and reduces the volume of a pressurized chamber in which the fuel is disposed, the high pressure in the fuel being generated on account thereof. The fuel that has been charged with high pressure in this way is then directed onward to elements of the fuel injection system that are downstream of the high-pressure fuel pump. For example, the injection of fuel into the combustion chambers of the internal combustion engine is often performed by way of a pressure accumulator, the so-called rail, which is why the fuel from the high-pressure fuel pump by way of corresponding valves is initially introduced into the rail.

Accordingly, in order for the elements of the fuel injection system that in the flow direction of the fuel are downstream of the high-pressure fuel pump to be able to be supplied with the pressurized fuel, a connection installation by way of which the high-pressure fuel pump can be connected to these downstream elements is provided.

A connection of the high-pressure fuel pump and of the connection installation is highly stressed in mechanical terms due to the high pressure that prevails in the fuel and due to the forces that are generated on account thereof. The peaks in pulsating tensile stress that arise on account thereof in the case of an unfavorable construction and dimensional layout of the connection or of the connection installation, respectively, can inter alia lead to a failure of the dynamically stressed connection between the connection installation and the high-pressure fuel pump. As a result thereof, this can lead to a leakage of fuel and to safety issues that are associated therewith, and is to be advantageously avoided.

It is therefore an object of the invention to propose a high-pressure connection device which can oppose the acting forces with a high resistive force.

This object is achieved by a high-pressure connection device having the features of claim 1.

A high-pressure fuel pump which has the high-pressure connection device, and a method for producing such a high-pressure connection device are the subject matter of the co-independent claims.

Advantageous design embodiments of the invention are the subject matter of the dependent claims.

A high-pressure connection device for connecting a high-pressure fuel pump to elements of a fuel injection system that in the flow direction of a fuel are downstream of the high-pressure fuel pump has an outlet installation for discharging fuel that is charged with pressure in the high-pressure fuel pump from the high-pressure fuel pump and a connection installation for connecting the outlet installation to the elements of the fuel injection system that in the flow direction of the fuel are downstream. The high-pressure connection device furthermore has a weld seam for connecting the outlet installation and the connection installation in a high-pressure-tight manner, and a pretensioning installation for exerting a pretensioning force in the direction of the outlet installation on the weld seam.

The outlet installation is preferably formed by a housing of the high-pressure fuel pump and has an outlet bore which connects the environment of the high-pressure fuel pump to a pressurized chamber of the high-pressure fuel pump.

The fuel flows from the pressurized chamber of the high-pressure fuel pump through the outlet bore into the connection installation and is from there directed onward to the downstream elements of the fuel injection system. Accordingly, the fuel flows from the outlet installation into the connection installation in a flow direction that is usually disposed so as to be parallel with a longitudinal axis of the connection installation. Accordingly, the longitudinal axis of the connection installation and the flow axis of the fuel are typically congruent.

It is accordingly provided in the high-pressure connection device that a stabilized connection is provided instead of a simple connection between the outlet installation and the connection installation in that a pretensioning force is applied to the connecting weld seam, said pretensioning force opposing forces that act on the weld seam. Herein, advantages of a pure pretensioned connection are combined with those of a pure welded connection so as to be able to oppose ever higher pressures with a force that stabilizes the connection. After all, the high-pressure fuel pump is in particular configured for charging the fuel with a high pressure between 300 bar and 800 bar (applications in the gasoline sector). Pressures of even up to 3000 bar can be achieved in the diesel sector. The high-pressure connection device in relation to such high pressures is significantly more robust than a high-pressure connection device in which only a pure screw connection or a pure welded connection has been used.

Accordingly, a combination of a welding process, for example by way of a laser, an electron beam, a capacitor discharge, or friction welding, etc., with a pretensioning installation by way of which the high-pressure connection including the weld seam is pretensioned is chosen. A welding process thus takes place initially, and the entire construction is subsequently braced. On account thereof, forces and stresses are transferred away from the weld seam to less stressed regions of the high-pressure connection and of the pretensioning installation to a surrounding housing. Moreover, the stress in the high-pressure connection device per se by way of a combination of the pretensioning force and a suitable design embodiment can also be set or limited, respectively, such that the integrity of operation in the high-pressure connection device and all other installed parts remains guaranteed even in the case of pressure requirements that are further increased.

A cost-effective welded connection can be implemented or sustained, respectively, by way of this new solution under further increased hydraulic-mechanical requirements and an increased pressure (in the range from 300 bar-800 bar in the case of gasoline, and in the range from 1500 bar-3000 bar in the case of diesel). Only the additional pretensioning installation and the necessary installation space are additionally required. The components that are known in the context of lower pressure levels can thus be further used, subject to slight modifications. Additionally, the potential for thickening the wall thickness in the high-pressure connection without causing any additional stress on the weld seam results, this benefiting increased safety in relation to shearing when tightening/fastening external pipe installations on or to the connection installation, respectively.

The upper pressure limit for the high-pressure connection device is derived from the combination of material resilience, the maximum achievable pretensioning force $F_v$ over the life span, and the diameter of the connection installation. In particular, the maximum achievable pretensioning force $F_v$ by virtue of thread-related losses, etc. becomes ever smaller as the diameter increases, such that an optimum should lie in the use of small diameters. Small diameters result in higher achievable pretensioning forces $F_v$, in combination with lower axial forces.

Advantageously, a pressure-relief valve is disposed in the outlet installation in such a manner that a valve opening of the pressure-relief valve opens into a fuel inlet volume in the connection installation, said fuel inlet volume being configured for admitting the fuel that flows out of the outlet installation into the connection installation.

A pressure-relief valve is advantageous for safeguarding those elements which are downstream of the high-pressure fuel pump. In order for the valve opening of the pressure-relief valve to be able to open into the fuel inlet volume of the connection installation, it is advantageous for sufficient installation space to be provided, this leading to the diameter of the connection installation being significantly enlarged as compared to an arrangement without such a pressure-relief valve. This larger diameter can have negative effects on the connection between the outlet installation and the connection installation, since a contact pressure is reduced by virtue of a larger contact face between the outlet installation and the connection installation.

The larger diameter has negative effects on pure pretensioned connections as used to date, as well as on pure welded connections.

In the case of a pure pretensioned connection, most often an internal biting edge is provided for sealing and a soft-metal disk is provided for equalizing tolerances. The diameter of this biting edge is now increased due to the larger diameter that is required for the installation space for the pressure-relief valve. Thus, the contact pressure between the braced parts drops by virtue of the larger face. Additionally, however, the maximum possible axial pretensioning force $F_v$ also drops by virtue of the greater friction losses in the thread.

As the diameter increases, any potential deviation on roundness, and deviations from the orthogonality of a biting edge, respectively, additionally have a significantly greater influence since the biting edge is located so as to be significantly more remote from the center. The soft-metal disk which is intended primarily to equalize the tolerances by way of the biting edge is to be impinged upon with a sufficiently high pretensioning force $F_v$ so as to achieve equalization of the tolerance deviation by way of plastic deformation. However, this pretensioning force $F_v$ drops because of the aforementioned reasons and now has to be transmitted to a larger face.

A welded connection by virtue of the size of the fused zone can equalize significantly more tolerances without losing tightness. Here, above all, narrow linkage lengths of often used micro weld seams have a restricting effect in terms of the pressure level, this leading to a construction which guides stresses away from the weld seam into the connection installation and the surrounding housing. The achievable thicknesses of the connection installation thus drop, and in the case of rising pressure a point at which the material is excessively stressed is reached.

The advantages of pretensioned connections and welded connections are unified in the high-pressure connection device in order to achieve higher pressure levels in the range, for example, from 300 bar-800 bar or higher, at a comparatively large diameter of the fuel inlet volume of the connection installation by virtue of the pressure-relief valve. An additional advantage lies in that already available assembly lines having already known and very well managed machining and welding processes can continue to be used.

The pretensioning installation preferably has a pretensioning face that is directed toward the outlet installation and for applying the pretensioning to the weld seam is supported on a contact face of the connection installation. Thus, the pretensioning force can advantageously be applied to the weld seam by way of the connection installation per se.

In one advantageous design embodiment, a contact region of the pretensioning face and of the contact face in the flow direction of the fuel is disposed so as to be substantially perpendicularly above the weld seam. On account thereof, the weld seam can preferably be destressed as efficiently as possible since any lifting or rupturing of the weld seam is effectively counteracted, and the pretensioning force required therefor is reduced.

The contact face on the connection installation is preferably provided so as to be encircling such that the pretensioning force can be applied uniformly across the weld seam by way of the circumference of the connection installation.

In one further preferred design embodiment, the contact region in the flow direction of the fuel is disposed so as to be substantially perpendicular to the flow direction such that the pretensioning force can preferably oppose those forces that act by way of the flowing fuel in a precise manner.

However, in an alternative design embodiment, the contact region in relation to the flow direction can also be disposed at an angle $\alpha$, in particular at an angle $30° < \alpha < 80°$, in particular $\alpha = 45°$. This has the advantage that a connection installation having a smaller external diameter can be used. The pretensioning installation is preferably configured such that said pretensioning installation is pulled over the connection installation so as to be assembled in the respective arrangement such that the pretensioning installation has to have a minimum internal diameter. Should the connection installation in that region in which the weld seam is disposed have a small external diameter, a contact region of the contact face and the pretensioning face potentially cannot be established any more. However, by way of an angular contact region, it is furthermore possible for a pretensioning force to be exerted on the weld seam.

A recess is preferably configured on the outlet installation, wherein the pretensioning installation is configured for engaging in the recess. On account thereof, the pretensioning installation can advantageously dissipate forces into the outlet installation. The recess on the outlet installation is preferably disposed so as to be encircling, and the pretensioning installation has an encircling wall that is likewise disposed on the circumference of the pretensioning installation, said wall engaging in the recess. A particularly reliable contact between the recess and the pretensioning installation is thus guaranteed.

Particularly advantageously, the recess has an external recess thread and the pretensioning installation has an internal pretensioning installation thread for engaging in the external recess thread. On account thereof, the pretensioning force can advantageously be applied particularly uniformly and firmly on the weld seam by screw-fitting the pretensioning installation onto the recess.

The pretensioning installation is formed by a nut, for example. Alternatively, however, the pretensioning installation can also be formed by a flange-screw assembly. The configuration as a nut has the advantage that the pretensioning force can be applied uniformly onto the weld seam by way of the entire circumference of the connection installation. A flange-screw assembly has the advantage that, on account thereof, more degrees of freedom and more space can be made available than in the case of an arrangement having a nut. For example, a flange-screw assembly has at least two screws which interact with a corresponding clearance in the outlet installation.

A groove which in particular is configured so as to be substantially circular is advantageously disposed in the outlet installation. The weld seam in one preferred embodiment is disposed in the groove and is thus provided so as to be advantageously sunk into the outlet installation. However, the weld seam in an alternative design embodiment can also be disposed in the direction toward a flow axis of the fuel beside the groove so as to be perpendicular to the flow axis of the fuel, that is to say be directed toward the longitudinal axis of the connection installation. The groove when disposed beside the weld seam can advantageously dissipate forces that act on the weld seam, and thus destress the weld seam.

A protrusion region of the connection installation is preferably disposed on a first end of the connection installation that is in contact with the outlet installation, wherein the protrusion region has a welding face on which the weld seam is disposed. By way of the protrusion region, a face by way of which the force can be exerted on the weld seam by the pretensioning installation is advantageously available. Herein the contact face by way of which the connection installation contacts the pretensioning installation on the protrusion region is preferably disposed so as to be opposite the welding face on which the weld seam is located. Accordingly, the protrusion region transmits the pretensioning force from the pretensioning installation to the opposite weld seam.

In a preferred design embodiment, a connection region of the connection installation for connecting the connection installation to elements of the fuel injection system that in the flow direction of the fuel are downstream is disposed on a second end of the connection installation that is opposite the first end. The connection installation herein on the second end advantageously has an external thread by way of which elements that are downstream of the connection installation can advantageously be readily fastened to the connection installation. An external diameter of the connection installation on the first end is preferably larger than on the second end. Preferably a smallest internal diameter of the pretensioning installation is larger than the external diameter on the second end, and smaller than the external diameter on the first end, so as to be able to simply pull the pretensioning installation over the connection installation, on the one hand, and so as to be able to establish a reliable contact with the protrusion region of the connection installation, on the other hand.

A high-pressure fuel pump for charging a fuel with high pressure has a high-pressure connection device as described above.

In a method for producing a high-pressure connection device for a high-pressure fuel pump, the following steps are carried out:

providing an outlet installation for discharging a fuel from the high-pressure fuel pump;

providing a connection installation for connecting the outlet installation to elements of a fuel injection system that in the flow direction of the fuel are downstream;

generating a weld seam for connecting the outlet installation and the connection installation;

disposing a pretensioning installation on the connection installation in such a manner that a pretensioning force in the direction of the outlet installation acts on the weld seam.

The weld seam herein can be generated by various welding methods such as, for example, beam welding from the outside (by means of electron beams or laser beams) or by means of capacitor discharge welding or friction welding methods, respectively, the latter being internal welding methods.

The weld seam will preferably be left to solidify prior to the pretensioning installation being disposed on the connection installation, so as to be able to guarantee positive transmission of the pretensioning force from the pretensioning installation to the weld seam.

Advantageous design embodiments of the invention will be explained in more detail below by means of the appended drawings. In the drawings.

Figure 1:
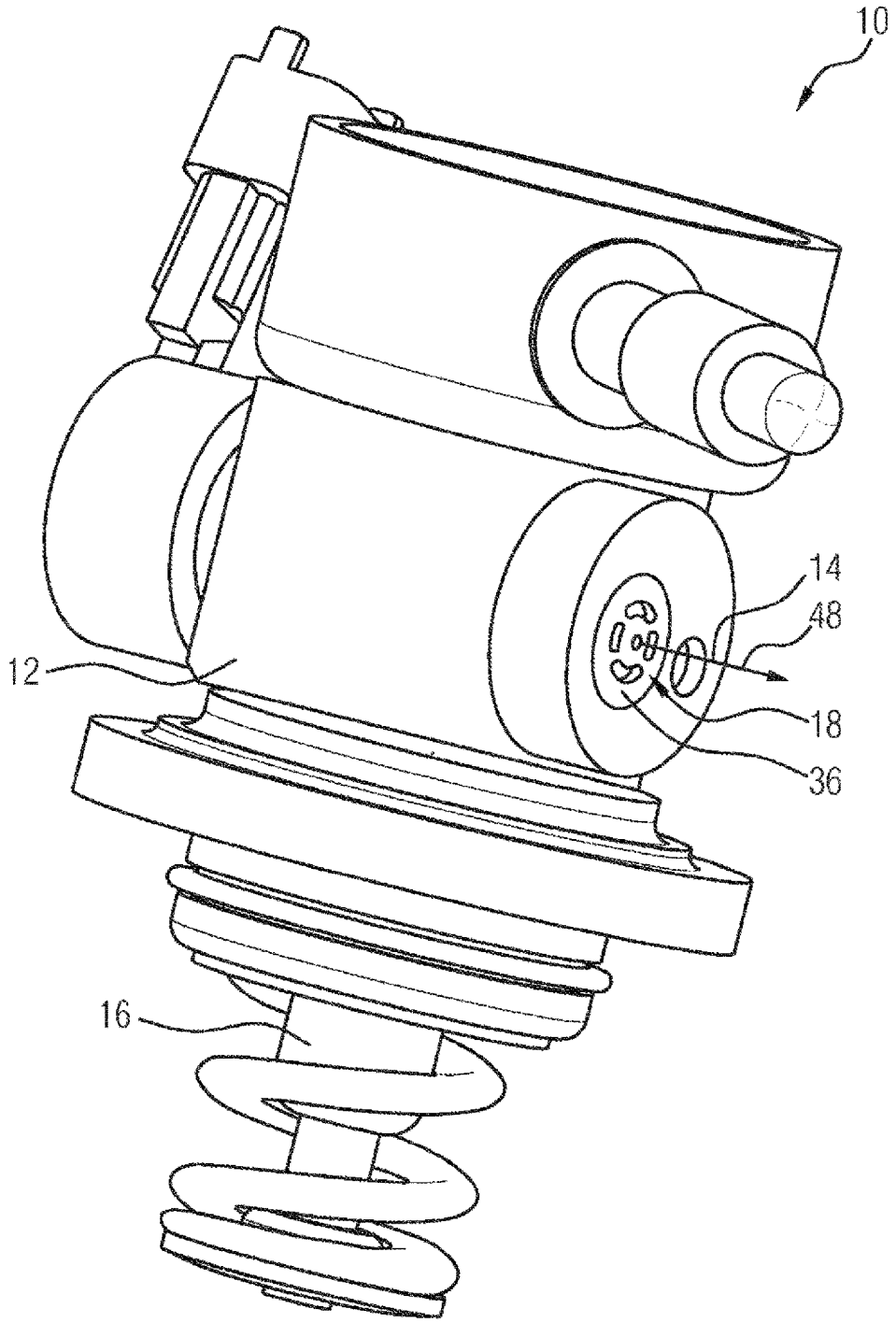
FIG. 1 shows a perspective view of a high-pressure fuel pump having an outlet installation for discharging a fuel that in the high-pressure fuel pump is charged with pressure.

FIG. 1 shows a perspective view of a high-pressure fuel pump 10 such as is used in a fuel injection system, for example. A pressurized chamber 24 (see FIG. 3) that is not visible in the perspective view of FIG. 1 is present in a housing 12 of the high-pressure fuel pump 10, a fuel 14 being charged with high pressure in said pressurized chamber 24.

Once the fuel 14 has been charged with high pressure, said fuel is discharged from the high-pressure fuel pump 12 by way of an outlet installation 18 that is disposed in the housing 12 and has an outlet bore 20, so as to be directed onward to elements which in the flow direction 48 of the fuel 14 are downstream of the high-pressure fuel pump 10.

Figure 2:
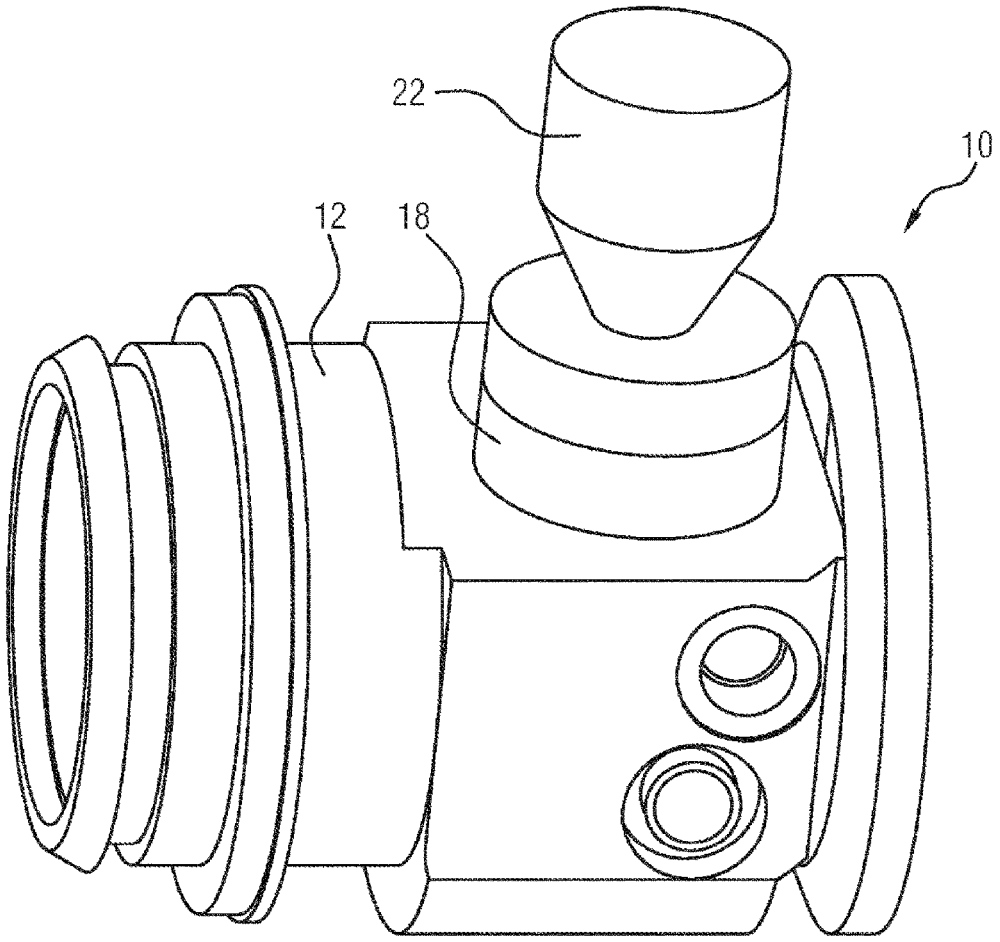
FIG. 2 shows a perspective view of a detail of the high-pressure fuel pump of FIG. 1, having a connection installation that is disposed on the outlet installation.

FIG. 2 shows a perspective view of a detail of the high-pressure fuel pump 10 of FIG. 1, wherein a connection installation 22 by way of which the outlet installation 18 is to be connected to the downstream elements of the fuel injection system is disposed on the outlet installation 18.

Figure 3:
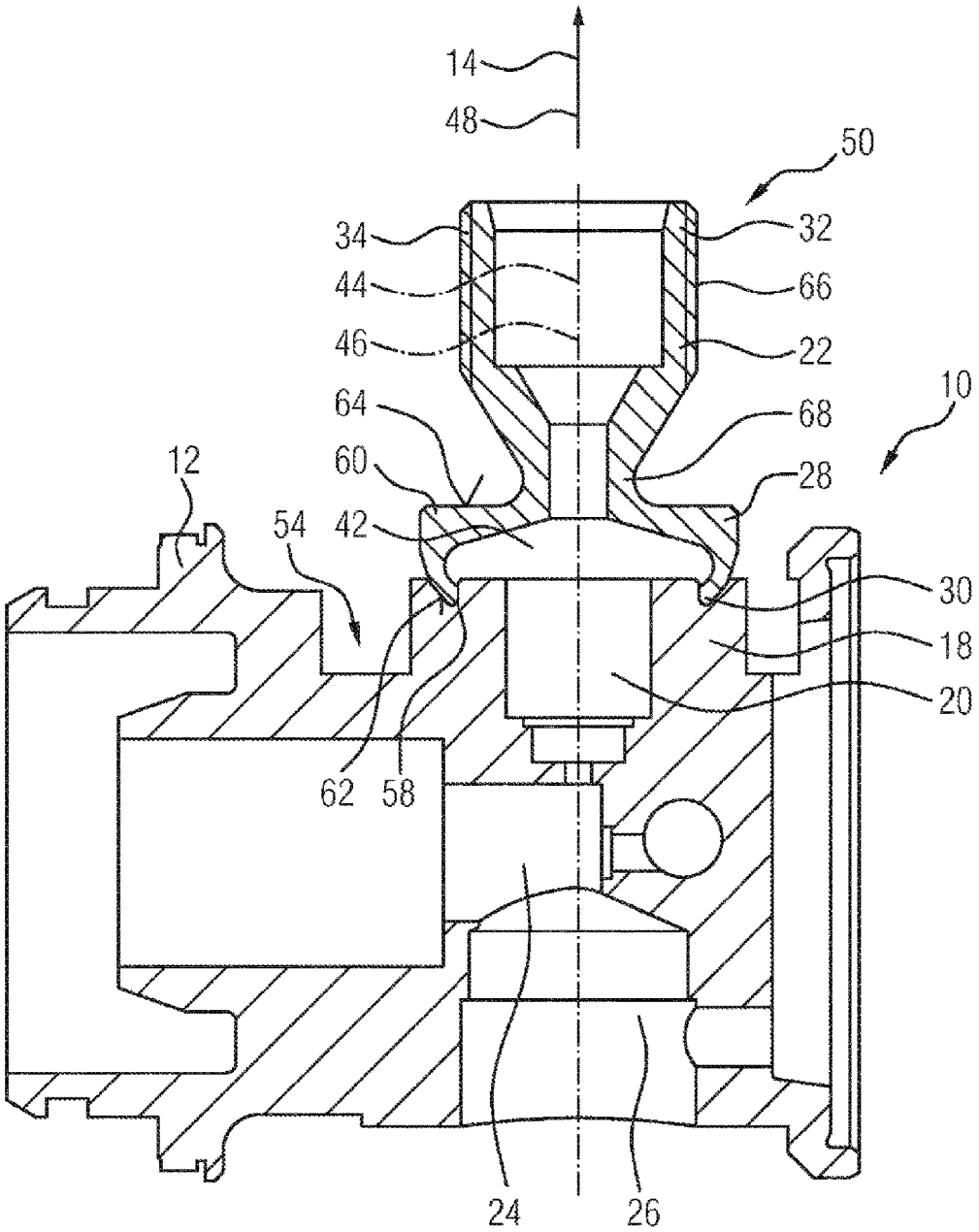
FIG. 3 shows a sectional view through the high-pressure fuel pump having a connection installation of FIG. 2.

FIG. 3 shows a sectional view through the perspective detailed view in FIG. 2, wherein the pressurized chamber 24, an inflow 26 to the pressurized chamber 24, and the outlet bore 20 in the outlet installation 18 of the housing 12 can now be seen in the housing 12 of the high-pressure fuel pump 10. It can furthermore be seen that the connection installation 22 at a first end 28 is connected to the outlet installation 18 by way of an encircling weld seam 30. At a second end 32, the connection installation 22 has a region by way of which the former can be connected to downstream elements of the fuel injection system. For example, an external thread 34 for connection to the downstream elements can be provided here.

Figure 4:
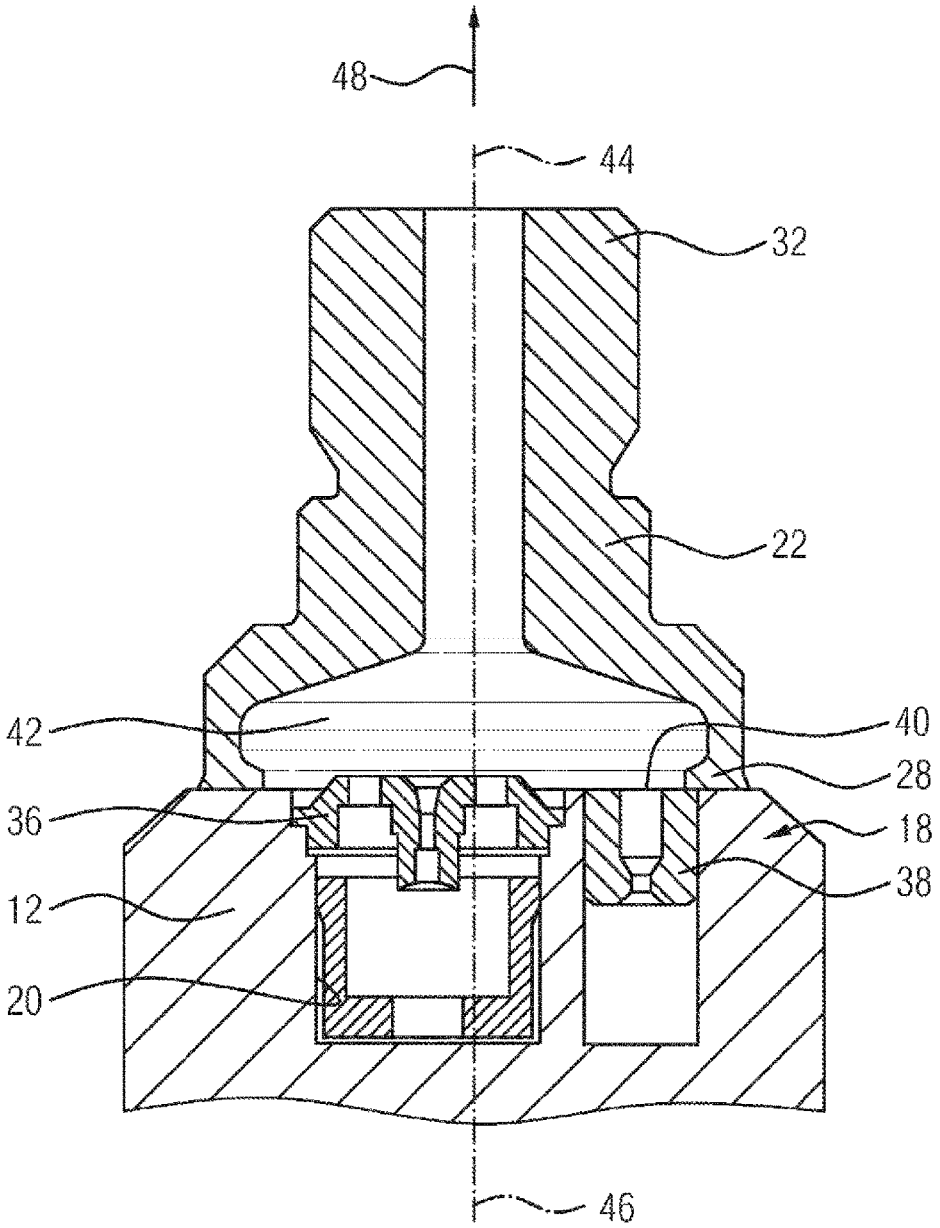
FIG. 4 shows a further sectional view of a high-pressure fuel pump having a connection installation, an outlet valve, and a pressure-relief valve.

FIG. 4 shows a further sectional view of a high-pressure fuel pump 10 having a connection installation 22, wherein an outlet valve 36 is disposed in the outlet installation 18, in particular in the outlet bore 20. Furthermore provided in the outlet installation 18 is a pressure-relief valve 38 which prevents that elements downstream of the high-pressure fuel pump 10 are impinged upon with excessive fuel pressure and thus are damaged. The pressure-relief valve 38 has a valve opening 40 which opens into a fuel inlet volume 42 of the connection installation 22. The outlet bore 20 also opens into this fuel inlet volume 42. The fuel inlet volume 42 tapers down from the first end 28 of the connection installation 22 toward the second end 32 of the connection installation 22, thus supplying the pressurized fuel 14 to the downstream elements of the fuel injection system.

The connection installation 22 for guiding the fuel 14 has a longitudinal axis 44 which is congruent with a flow axis 46 which runs along the flow direction 48 of the fuel 14.

The outlet installation 18 and the connection installation 22, when interconnected, form a high-pressure connection device 54 by way of which the high-pressure fuel pump 10 can be connected to elements of the fuel injection system that are downstream of the high-pressure fuel pump 10.

In order for the outlet installation 18 and the connection installation 22 to be connected, no longer is only the weld seam 30 as shown in FIG. 3 now used, but a pretensioning installation 52 which is disposed such that the latter can apply a pretensioning force $F_v$ to the weld seam 30 is additionally applied. The combination of the weld seam 30 and the pretensioning installation 52 will be explained in more detail hereunder by means of FIG. 5 to FIG. 12.

The features of the elements of the high-pressure connection device 50 that will be initially described hereunder are common to all embodiments described in the following.

The outlet installation 18 has a recess 54 in which a wall 56 of the connection installation 22 that is disposed so as to be parallel with the flow axis 46 of the fuel 14 can engage, so as to be supported on said recess 54. The recess 54 herein preferably has a depth of at least 5 mm, so as to be able to guarantee positive support of the connection installation 22 on the outlet installation 18.

A groove 58 is additionally disposed in the outlet installation 18, in order to provide flexibility for the assembly and the welding procedure when attaching the weld seam 30, that is to say in order to make available more spatial degrees of freedom for attaching the weld seam 30. The groove is preferably disposed in an encircling manner on a surface of the outlet installation 18.

The connection installation 22 has a protrusion region 60 which on a side that is directed toward the outlet installation 18 comprises a welding face 62 on which the weld seam 30 is disposed. The connection installation 22 on the opposite side of the protrusion region 60, that is to say the side that is disposed so as to be directed away from the outlet installation 18, has a contact face 64 by way of which said connection installation 22 is in contact with the pretensioning installation 52. The protrusion region 60 is disposed on the first end 28 of the connection installation 22. Opposite the protrusion region 60 on the second end 32 of the connection installation 22, the connection installation 22 has a connection region 66 by way of which the high-pressure connection device 50 can be connected to downstream elements of the fuel injection system. A neck region in which the connection installation 22 has the smallest external diameter is provided between the connection region 66 and the protrusion region 60. The connection region 66 can optionally have the external thread 34, and moreover has a smaller external diameter than the protrusion region 60.

The external diameter of the protrusion region 60 is defined by the required fuel inlet volume 42 into which not only the outlet bore 20 of the high-pressure fuel pump 12 but also the valve opening of the pressure-relief valve 38 open, as is shown in FIG. 4. On account thereof, an internal diameter in the protrusion region 60 of 16 mm results, for example, the latter defining the external diameter of the protrusion region 60.

The pretensioning installation 52 has a pretensioning face 70 with which the contact face 64 is in contact so as to apply the pretensioning force $F_v$ to the weld seam 30. An internal diameter of the pretensioning installation 52 is larger than the external diameter on the connection region 66 such that the pretensioning installation can be pulled over the connection installation 22. At the same time, the smallest internal diameter of the pretensioning installation 52 is smaller than the external diameter of the protrusion region 60 such that the pretensioning installation 52 can be supported on the protrusion region 60.

By way of the pretensioning installation 52, a pretensioning force of approximately 4 kN-8 kN, for example, can be applied to the weld seam 30 which has a linkage length of approximately 1.9 mm to 2.2 mm, for example, and a width of approximately 0.2 mm to 0.4 mm, for example.

Figure 5:
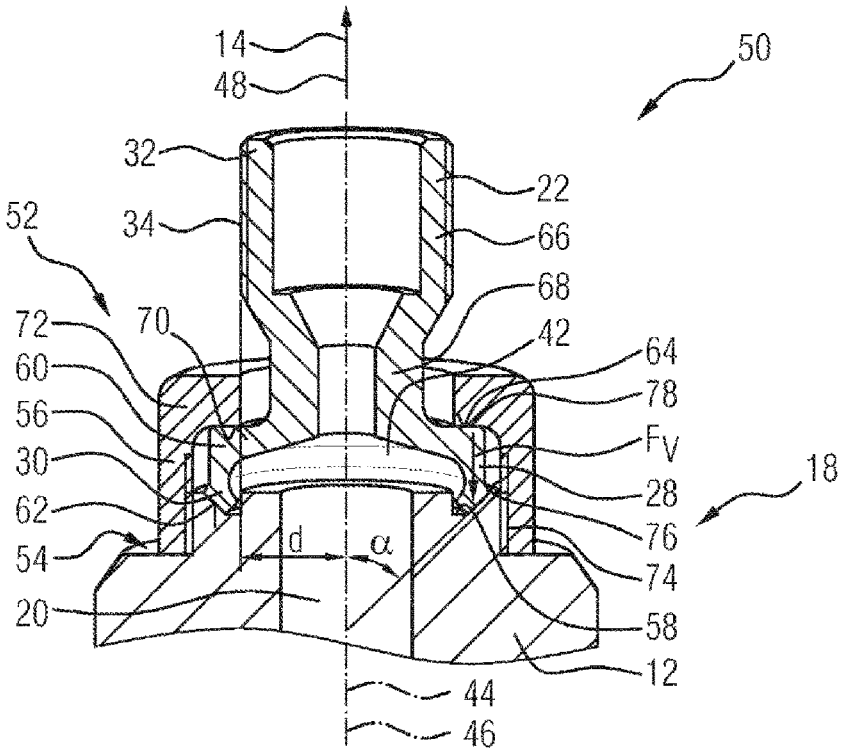
FIG. 5 shows a sectional view of a high-pressure connection device on a high-pressure fuel pump as shown in FIG. 1, according to a first embodiment.
Figure 6:
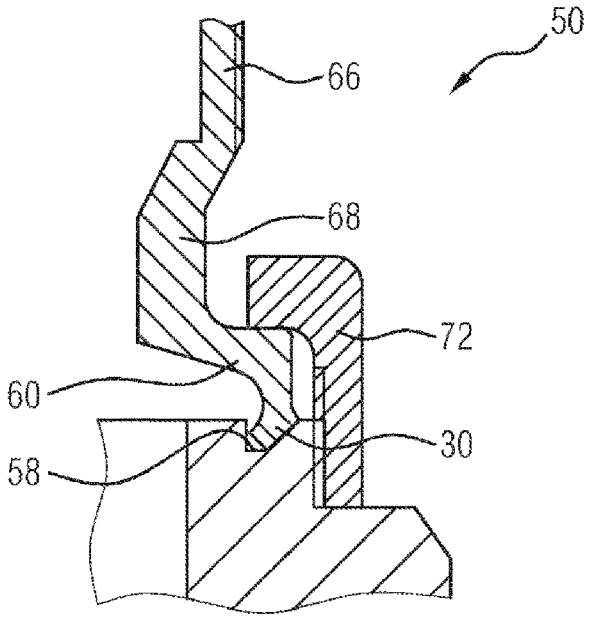
FIG. 6 shows a schematic illustration of stress distribution in individual regions of the high-pressure connection device according to FIG. 5.

FIG. 5 and FIG. 6 show sectional views of a first embodiment of the high-pressure connection device 50.

The pretensioning installation 52 here is configured as a nut 72, wherein the recess 54 has an external recess thread 74 and the nut 72 has an internal pretensioning installation thread 76 which engages in the external recess thread 74. The contact face 64 of the connection installation 22 and the pretensioning face 70 of the pretensioning installation 52 are in contact in a contact region 78 which is disposed so as to be perpendicular to the flow direction 48 of the fuel 14. Furthermore, the contact region 78 in the embodiment shown in FIG. 5 and FIG. 6 in the flow direction 48 of the fuel 14 is disposed so as to be substantially perpendicularly above the weld seam 30 and thus has approximately the same spacing d from the flow axis 46 as does the weld seam 30. On account thereof, the weld seam 30 is destressed as efficiently as possible, since lifting or rupturing of the weld seam can be effectively counteracted. The pretensioning force $F_v$ required therefor is simultaneously reduced as compared to the case in which the weld seam 30 is not destressed and a higher pretensioning force $F_v$ thus has to be applied in order for the weld seam 30 to be stabilized. Thus, a mean stress which engages on the external thread 34 in the connection region 66 also becomes lower and therefore the integrity of operation becomes higher. In the case of the arrangement illustrated in FIG. 5, almost all potential weld seam angles of a contact face of the weld seam with the outlet installation 18 in relation to the flow direction 48 in the range from 0° to 90° are also possible in the case of the connection of the outlet installation 18 and the connection installation 22.

FIG. 6 shows a fragment of the sectional view in FIG. 5 with stresses acting in the individual regions illustrated, wherein the stresses are lower as the coloration becomes darker. The weld seam 30 in the embodiment according to FIG. 5/FIG. 6 runs in the groove 58.

In the first embodiment shown in FIG. 5 and FIG. 6, a weld seam 30 that is welded conventionally from the outside, having a nut as a union nut, is thus illustrated. It is particularly advantageous in the case of this embodiment that known arrangements of high-pressure connection devices 50 and the processes associated therewith which are known from the production of high-pressure fuel pumps 10 of lower pressure levels can be appropriated without any major modifications. Despite the increase in pressure, there is furthermore the potential of maintaining the installation space and thus any optionally available components below the connection installation 22. Besides the outlet valve 36, the pressure-limiting valve 38 that in most instances is likewise installed below this connection installation 22 becomes particularly significant herein, since said pressure-limiting valve 38 to some extent safeguards components that are downstream of the high-pressure fuel pump 10, such as the injectors and the rail, for example, against excessive pressure peaks. The excess medium is then conveyed away in a controlled manner by way of the high-pressure region of the pump.

Figure 7:
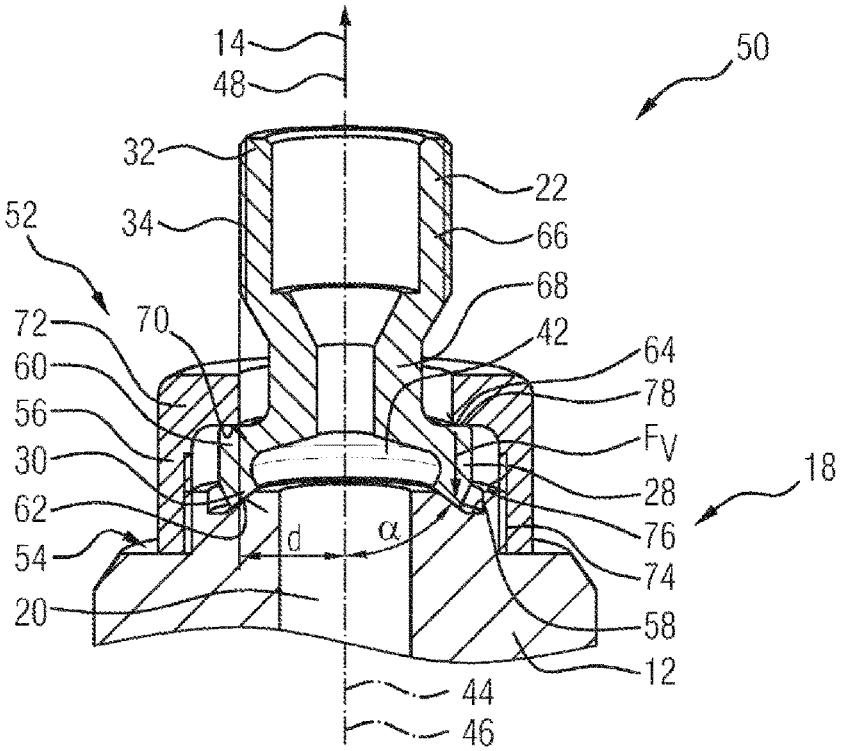
FIG. 7 shows a sectional view of a high-pressure connection device on a high-pressure fuel pump as shown in FIG. 1, according to a second embodiment.
Figure 8:
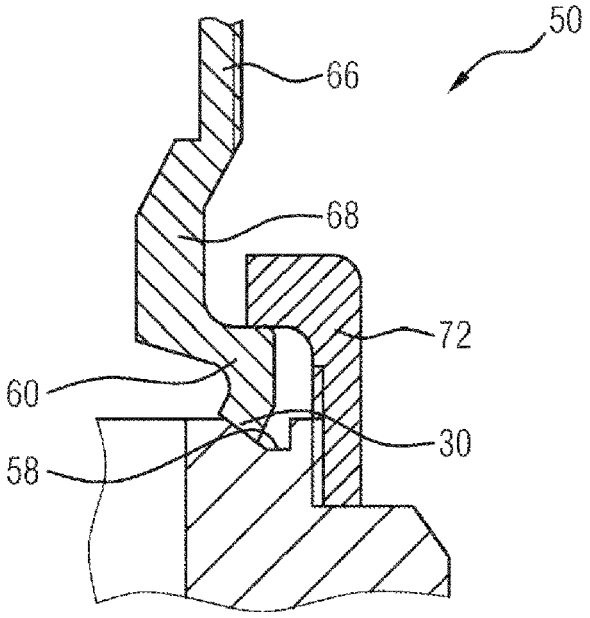
FIG. 8 shows a schematic illustration of stress distribution in individual regions of the high-pressure connection device according to FIG. 7.

FIG. 7 and FIG. 8 show a sectional view of a second embodiment of the high-pressure connection device 50 which is of substantially the same construction as the high-pressure connection device 50 of FIG. 5 and FIG. 6, the difference being that the weld seam 30 here does not run within the groove 58 but is disposed so as to be offset away from the groove 58 in the direction toward the flow axis 46 of the fuel 14. The groove 58 here contributes to directing forces that act on the weld seam 30 away from the weld seam 30 and to thus destressing the latter even more intensely.

The stresses acting in this embodiment are schematically illustrated in FIG. 8 in a manner analogous to FIG. 6.

Figure 9:
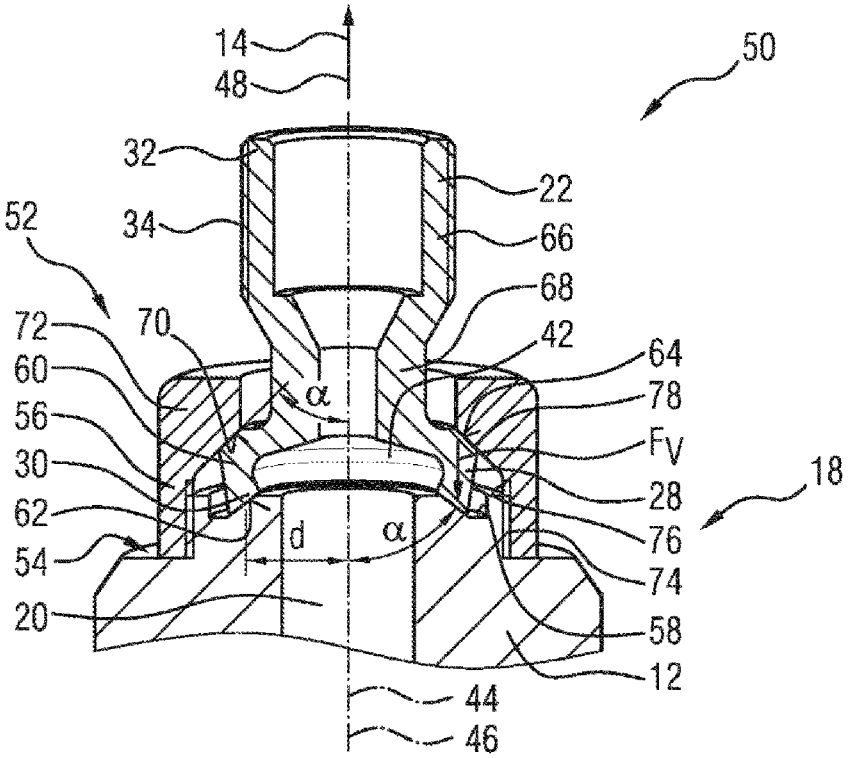
FIG. 9 shows a sectional view of a high-pressure connection device on a high-pressure fuel pump as shown in FIG. 1, according to a third embodiment.
Figure 10:
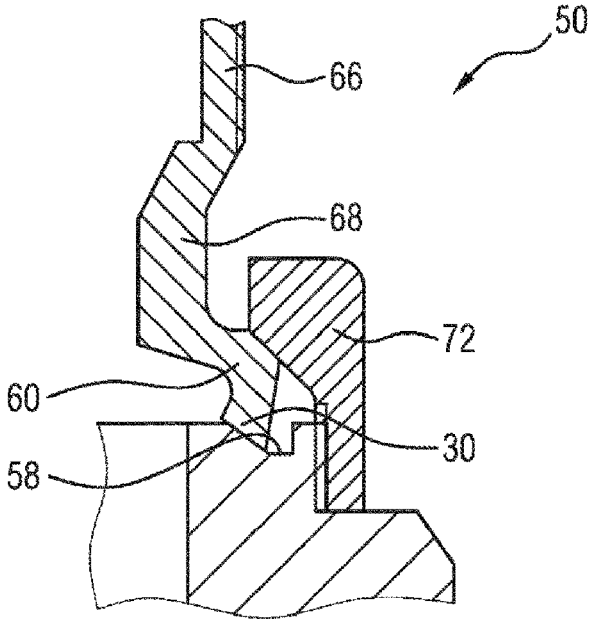
FIG. 10 shows a schematic illustration of stress distribution in individual regions of the high-pressure connection device according to FIG. 9.

FIG. 9 and FIG. 10 each show a sectional view of a third embodiment of the high-pressure connection device 50, wherein the contact region 78 here is not aligned so as to be perpendicular to the flow direction 48 of the fuel 14, but at an angle $\alpha$ which is within a range from 30° to 80°, in the present example of 45°. The arrangement in the high-pressure connection device 50 otherwise corresponds to the arrangement that is shown in FIG. 7.

FIG. 10, in a manner analogous to that of FIG. 6 and FIG. 8, herein schematically shows the stresses acting in the third embodiment.

The protrusion region 60 in the embodiment in FIG. 9 has a smaller internal diameter and also a smaller external diameter than in the preceding embodiments, on account of which the weld seam 30 moves inward in the direction toward the flow axis 46 such that the introduction of the pretensioning force $F_v$ directly above the weld seam 30, as is shown in the embodiment according to FIG. 5, is no longer possible. This is because the pretensioning installation 52 which is intended to be pulled over the connection installation 22 requires a minimum internal diameter in order to be able to pass the connection region 66 having the external thread 34 disposed thereon. It is therefore proposed in the embodiment according to FIG. 9 that an oblique weld seam 30 and a contact face 64 or a pretensioning face 70, respectively, that is embodied at a similar angle thereto is provided. On account thereof, the forces can be introduced and distributed in such a targeted manner that the weld seam 30 and the further participating components are not excessively stressed. The weld seam 30 here was generated by means of capacitor discharge welding.

Figure 11:
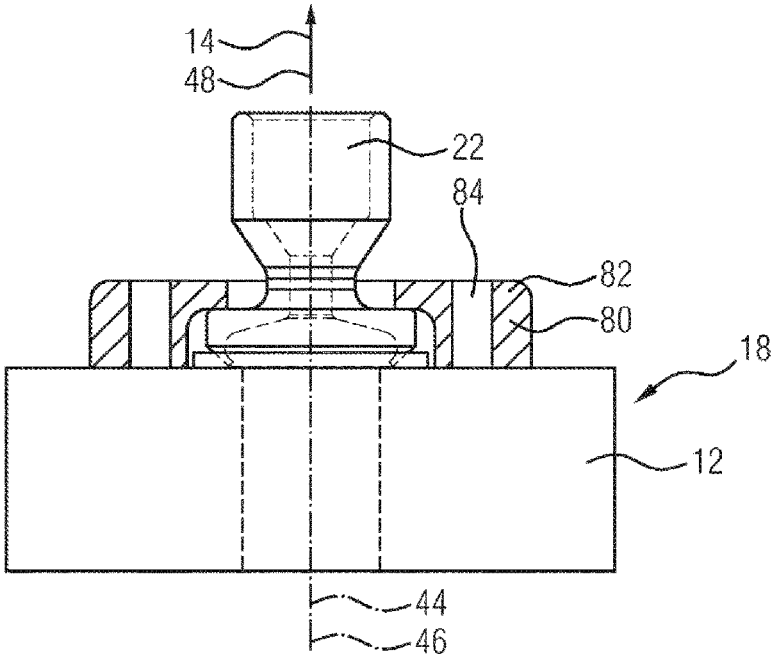
FIG. 11 shows a perspective view of a high-pressure connection device on the high-pressure fuel pump according to FIG. 1, according to a fourth embodiment.
Figure 12:
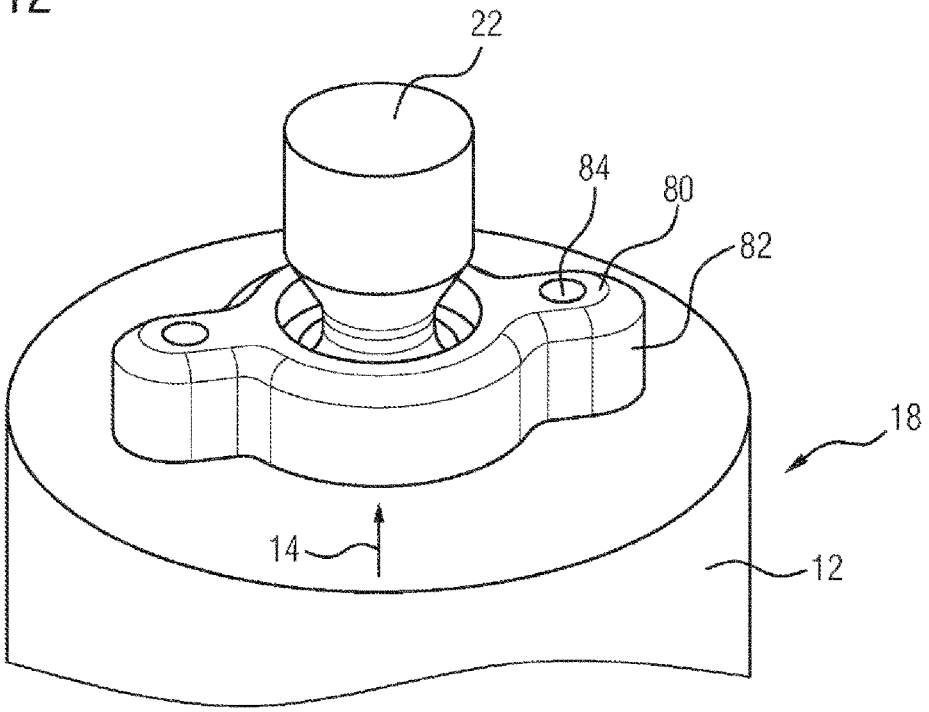
FIG. 12 shows a further perspective view of the high-pressure connection device of FIG. 11.

FIG. 11 and FIG. 12 show perspective views of a fourth embodiment, in which a flange-screw assembly 80 instead of a nut 72 is used as the pretensioning installation 52, in the case of which a flange 82 by way of its pretensioning face 70 is supported on the contact face 64 of the connection installation 22 and screw bores 84 through which screws can engage into the housing 12 of the high-pressure fuel pump 10 or into the outlet installation 18, respectively, are provided.

Accordingly, a flange-screw assembly 18 can also be used instead of a nut 72 as the pretensioning installation 52. As opposed to the flange-screw assembly 80, the nut 72 offers the advantage that the pretensioning force $F_v$ introduced is introduced uniformly into all regions. This is most often not the case when a flange 82 is used. However, a flange 82 does have the advantage that the latter in terms of the installation space can be designed in a significantly more flexible manner.

In known arrangements, the high-pressure connection that by welding (for example by way of an electron beam or a laser beam) is fixedly connected to the housing 12 of the high-pressure fuel pump 10 is highly stressed in mechanical terms in and beside the weld seam 30 by the forces that are generated by the high pump pressure that arises in the high-pressure connection.

To date, circular weld seams 30 have been generated by way of a beam direction that is in a direction perpendicular or angular in relation to the longitudinal axis 44 of the connection installation 22 and from the outside in the direction of the longitudinal axis 44 along the contact line of the two parts to be connected. The penetration depth when welding could thus be maximized, this in turn leading to the forces resulting axially from the internal pressure stress being minimized. Despite the consistent projected face, the loads and the stresses Engaging on account thereof on the weld seam 30 increase in the case of comparatively high pressures. This face could be further minimized by a method in which the high-pressure connection is welded from the inside (for example by capacitor discharge welding).

By minimizing the projected axial face and by way of a construction that is tailored to stress and offers operational integrity, the construction of the high-pressure connection device 50 as described attempts to minimize the loads that engage on the weld seam 30.

In order for the maximum resilience to be able to be further increased, the high-pressure connection device 50 which by using a pretensioning installation 52 such as, for example, a nut 72 or a flange-screw assembly 80 causes pretensioning of the weld seam 30 is proposed, such that a simple welding process can continue to be used for sealing and for materially-integral connecting at a consistent axial face and an increased pressure level.

The invention claimed is:

1. A high-pressure connection device for connecting a high-pressure fuel pump to one or more elements of a fuel injection system, the high-pressure connection device comprising:

an outlet which discharges fuel from the high-pressure fuel pump;

a connector connecting the outlet to the one or more elements of the fuel injection system;

a weld seam which connects the outlet and the connector; and a pretensioner configured to exert a tension force on the weld seam, the pretensioner directly contacting the connector and directing connected to the outlet.

2. The high-pressure connection device of claim 1, further comprising a fuel inlet volume in the connector, and a pressure-relief valve disposed in the outlet such that the pressure-relief valve opens into the fuel inlet volume, wherein the fuel inlet volume is configured to admit fuel that flows out of the outlet and into the connector.

3. The high-pressure connection device of claim 1, wherein the pretensioner has a pretensioning face directed toward the outlet and which applies the tension force to the weld seam, the weld seam being supported by a contact face of the connector.

4. The high-pressure connection device of claim 3, wherein the pretensioning face and the contact face of the connector are in contact in a contact region disposed so as to have the same distance from a flow axis of fuel through the high pressure connection device and a longitudinal axis of the connector as a distance of the weld seam to the flow axis and the longitudinal axis.

5. The high-pressure connection device of claim 3, wherein the pretensioning face and the contact face of the connector are in contact in a contact region disposed so as to be substantially perpendicular to a flow direction of fuel through the high-pressure connection device.

6. The high-pressure connection device of claim 3, wherein the pretensioning face and the contact face of the connector are in contact in a contact region disposed so as to be between 30 degrees and 80 degrees to a flow direction of fuel through the high-pressure connection device.

7. The high-pressure connection device of claim 6, wherein the contact region is disposed at 45 degrees to the flow direction of fuel through the high-pressure connection device.

8. The high-pressure connection device of claim 1, further comprising a recess on the outlet, wherein the pretensioner is configured to engage the recess, the recess has an external recess thread and the pretensioner has an internal pretensioning installation thread.

9. The high-pressure connection device of claim 1, further comprising a substantially circular groove disposed in the outlet, wherein the weld seam is disposed in at least one of the groove and a flow axis of fuel in the high-pressure connection device beside the circular groove so as to be perpendicular to the flow axis of fuel.

10. The high-pressure connection device of claim 1, further comprising a protrusion region disposed on a first end of the connector, the protrusion region contacting the outlet, wherein the protrusion region comprises a welding face on which the weld seam is located.

11. The high-pressure connection device of claim 10, wherein a connection region of the connector for connecting the connector to the one or more elements of the fuel injection system is disposed on a second end of the connector opposite the first end thereof, and the second end of the connector has an external thread.

12. The high-pressure connection device of claim 10, wherein a connection region of the connector for connecting the connector to the one or more elements of the fuel injection system is disposed on a second end of the connector opposite the first end thereof, and an external diameter of the connector at the first end thereof is larger than an external diameter of the connector at the second end of the connector.

13. A high-pressure fuel pump for charging a fuel with high pressure, comprising:

a high-pressure connection device for connecting the high-pressure fuel pump to one or more elements of a fuel injection system, the high-pressure connection device including:

an outlet, which discharges fuel from the high-pressure fuel pump;

a connector connecting the outlet to the one or more elements of the fuel injection system;

a weld seam which connects the outlet and the connector; and a pretensioner configured to exert a tension force on the weld seam, the pretensioner directly contacting the connector and directing connected to the outlet.

14. A method for providing a high-pressure connection for a high-pressure fuel pump, the method comprising:

providing an outlet for discharging a fuel from the high-pressure fuel pump;

providing a connector configured to connect the outlet to at least one element of a fuel injection system;

generating a weld seam that connects the outlet to the connector; and exerting a pretensioning force on the weld seam in a direction of the outlet, comprising directly connecting a pretensioner to the outlet such that a pretension face of the pretensioner contacts a contact face of the connector and applies the pretensioning force to the weld seam.

15. The high-pressure connection device as claimed in claim 1, wherein the pretensioner comprises one of a nut which has a threaded engagement with the outlet and a flange assembly with at least one through-bore in which at least one fastener is disposed that engages with the outlet.

16. The high-pressure fuel pump of claim 13, wherein the connector has a contact face and the pretensioner has a pretensioning face that contacts the contact face and is directed toward the outlet and applies the tension force to the weld seam, and the pretensioning face and the contact face of the connector are in contact in a contact region disposed so as to be at least one of at an oblique angle relative to a longitudinal axis of the connector and a flow axis of fuel through the connector, and the same distance from the flow axis of fuel and the longitudinal axis of the connector as a distance of the weld seam to the flow axis and the longitudinal axis.

17. The high-pressure fuel pump of claim 16, wherein the oblique angle is between 30 degrees and 80 degrees to the flow direction and the longitudinal axis of the connector.

18. The high-pressure fuel pump of claim 13, wherein the connector has a contact face and the pretensioner has a pretensioning face that contacts the contact face and is directed toward the outlet and applies the tension force to the weld seam, and the pretensioning face and the contact face of the connector are in contact in a contact region disposed so as to be at a first oblique angle relative to a longitudinal axis of the connector and a flow axis of fuel through the connector, and the weld seam is at a second oblique angle relative to the longitudinal axis and the flow axis.

19. The high-pressure fuel pump of claim 13, wherein the outlet includes a recess, the pretensioner is configured to engage the recess, and the recess has an external recess thread and the pretensioner has an internal pretensioning installation thread.

20. The high-pressure fuel pump of claim 13, further comprising a substantially circular groove disposed in the outlet, wherein the weld seam is disposed in at least one of the groove and a flow axis of fuel in the high-pressure connection device beside the circular groove so as to be perpendicular to the flow axis of fuel.

* * * * *